United States Patent [19]

Hofmann et al.

[11] 4,273,088

[45] Jun. 16, 1981

[54] APPARATUS FOR SETTING THE ANGULAR RELATIONSHIP BETWEEN ROTATING DRIVING, AND DRIVEN MEMBERS

[75] Inventors: Eberhard Hofmann, Kirchberg; Ernst Ritter, Stuttgart; Heinrich Staudt, Markgröningen, all of Fed. Rep. of Germany

[73] Assignee: Robert Bosch GmbH, Stuttgart, Fed. Rep. of Germany

[21] Appl. No.: 14,199

[22] Filed: Feb. 22, 1979

[30] Foreign Application Priority Data

Feb. 23, 1978 [DE] Fed. Rep. of Germany ..... 2807737

[51] Int. Cl.[3] ..... F02D 1/04; F02M 39/00

[52] U.S. Cl. ..... 123/502; 123/387; 123/501

[58] Field of Search ..... 123/139 AP, 139 AQ, 123/139 AY, 140 FG, 140 MC, 387, 501, 502

[56] References Cited

U.S. PATENT DOCUMENTS

| | | | |
|---|---|---|---|
| 2,174,526 | 10/1939 | Parker | 123/139 AP |
| 2,719,517 | 10/1955 | Adler | 123/140 FG X |
| 3,640,258 | 2/1972 | Isobe et al. | 123/140 FG |
| 3,815,564 | 6/1974 | Suda et al. | 123/139 AP |
| 3,951,117 | 4/1976 | Perr | 123/139 AP X |
| 3,968,779 | 7/1976 | Davis | 123/140 FG |
| 4,014,305 | 3/1977 | Skinner et al. | 123/139 AQ |
| 4,019,835 | 4/1977 | Skinner | 123/139 AQ |
| 4,026,260 | 5/1977 | Kleimenhagen | 123/140 MC X |
| 4,062,335 | 12/1977 | Rank | 123/139 AP |

FOREIGN PATENT DOCUMENTS

| | | | |
|---|---|---|---|
| 896431 | 11/1953 | Fed. Rep. of Germany | 123/139 AQ |
| 1274850 | 8/1968 | Fed. Rep. of Germany . | |
| 820850 | 11/1937 | France | 123/139 AQ |
| 892561 | 4/1944 | France | 123/139 AQ |

*Primary Examiner*—Stuart S. Levy

*Attorney, Agent, or Firm*—Edwin E. Greigg

[57] ABSTRACT

An apparatus for setting the angular relationship between rotating driving, and driven members in the injection pump drive of an internal combustion engine. The driving member and the driven member have a toothed portion of which at least one is a helical toothed portion, whereby the toothed portions are coupled to each other by a coupler member having toothed portions which mesh with the toothed portions of the driving and driven members. At least one of the toothed portions of the coupler member is configured as a helical portion and is hydraulically displaceable with respect to the other toothed portions. This hydraulic displacement is controlled by a centrifugal governor having flyweights. The flyweights displace a valve member against the force of at least one spring in an rpm-dependent manner to effect the rpm-dependent adjustment of the instant of injection. In addition to the rpm-dependent displacement, a load-dependant displaceability, can be superimposed. As a result, the instant of injection can be influenced in accordance with load, in order thus to attain an improved combustion efficiency.

14 Claims, 6 Drawing Figures

APPARATUS FOR SETTING THE ANGULAR RELATIONSHIP BETWEEN ROTATING DRIVING, AND DRIVEN MEMBERS

BACKGROUND OF THE INVENTION

The invention relates to an apparatus for setting the angular relationship between rotating driving, and driven members, as is already known from German Auslegeschrift (published patent application) No. 1,274,850, which is equivalent to U.S. Pat. No. 3,050,964. In this known apparatus, the angular relationship between the rotating driving member, and driven member can be adjusted only in accordance with rpm.

OBJECT AND SUMMARY OF THE INVENTION

The present invention has as its principal object the improvement of the apparatus as disclosed, for example in the noted publication, such that in addition to the rpm-dependent setting of the angular relationship between the driving and the driven members, dependance on load or the position of the regulator device can also be provided.

The invention provides for a superimposition of a load-dependent displacement of at least one helical toothed portion of a member coupling the driving and driven members, in addition to the rpm-dependent displacement of, preferably, the same helical toothed portion, in order to adjust the instant of injection of an internal combustion engine. In this way a better level of efficiency and therefore higher torque and higher power in the full-load range can be achieved. Furthermore, the combustion can be improved so that a better observance of the exhaust gas regulations is possible.

In a particularly advantageous embodiment, the position of a regulator rod of the injection pump can serve as the load-dependent superimposed value, by which means the injection quantity is regulated. The position of the regulator rod corresponds, in general, approximately to the torque produced by the engine, so that a relatively exact load-dependent regulatory value is available, and this value can be made useable with limited expense. In order to adapt the superimposition of the load-dependent displacement, a load-dependently adjustable cam plate can advantageously be provided, which acts directly or indirectly on a valve member. By appropriately selecting the profile of the cam plate, an adaptation to various given circumstances is generally possible. With the intermediate inclusion of at least one pre-stressed spring, and with, for example, a swingable lever, whose free end cooperates with the valve member, the cam plate can efficiently act on the valve member, the lever being loaded with a force in accordance with the regulator rod position.

A particularly simple arrangement can be attained in that the cam plate is rotatable in accordance with the motion of the regulator rod and that a guide, displaceable by the cam plate, is provided with a spring disposed on the guide, whereby this spring then acts on the swingable lever.

In a preferred embodiment, the guide can be a sleeve with a contact connection for the spring, whereby this sleeve is displaceably guided on a guide rod. In order to obtain the easiest possible movement of the sleeve on the guide rod, an identical cam plate can be provided on both sides of the guide rod and parallel to it.

In order to limit the load-dependence to a certain range, the pivotal range of the swingable lever can be particularly simply limited by a preferably adjustable stop.

A reverse effect of the pickup on the regulator rod can be simply avoided in that the regulator rod cooperates with a hydraulically guided subsequent follow-up piston, whereby the gear wheel then engages a gearing means of the follow-up piston.

DESCRIPTION OF THE PREFERRED EMBODIMENTS

Figure 1:
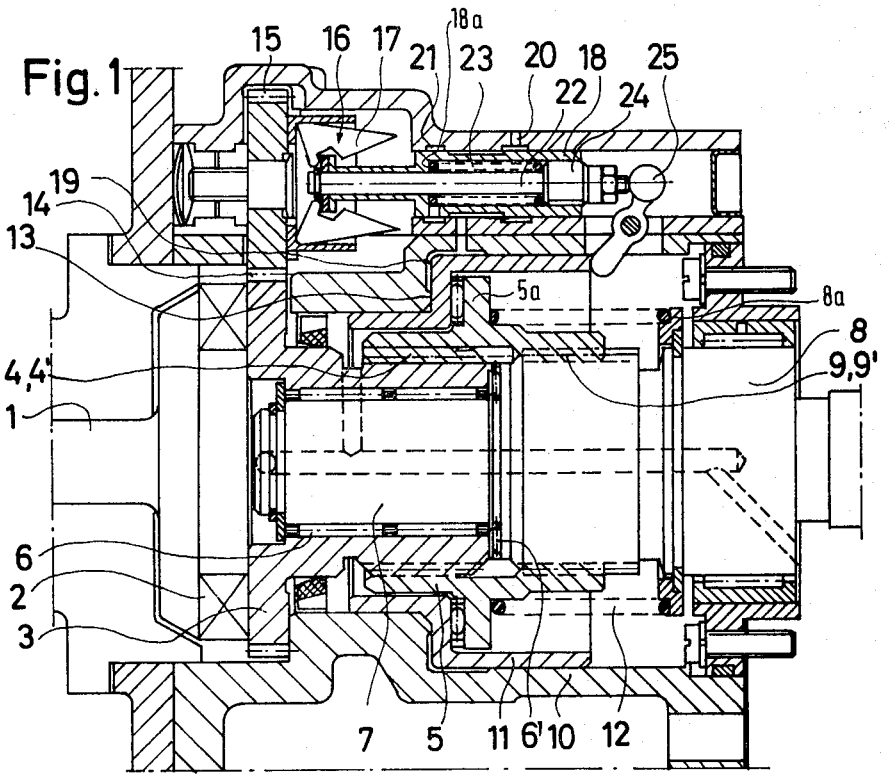
FIG. 1 is a longitudinal cross-sectional view through an apparatus for setting the angular relationship between a rotating driving member and a driven member of the apparatus, with a centrifugal governor, which is adapted to displace, via a follow-up piston, a sleeve which includes gear teeth meeting with corresponding gear teeth on the driving and driven members.

In all the described examples of the invention, the same reference numerals are used for the part which corresponds to a similar part in the other views.

Before discussing in detail the two disclosed preferred embodiments of the invention, a discussion of the general apparatus with which the invention is associated will be considered.

In the apparatus shown only in part in FIG. 1, a driving member 3 is drivable via a drive shaft 1 and a coupling 2. This driving member 3 carries a helical gear portion 4, which is in engagement with a complemental meshing gear portion 4' of a coupler sleeve 5. The drive member 3 is supported via needle bearings 6, 6' on a stub portion 7 of a driven member 8, and is connected, via a further meshing toothed portion 9' of the sleeve 5, with a toothed portion 9 of the driven member 8. The two toothed portions 4' and 9' are arranged coaxially on the sleeve 5. The sleeve 5 is rotatably supported within a work piston 11. A compression spring 12 is disposed between an annular flange 5a of the sleeve 5 and a spring support 8a of the driven member 8, by means of which spring the work piston 11 is urged to the left as viewed in FIG. 1 and against a shoulder 13 of a housing 10 whenever it is not under pressure. The member 8 is supported in the housing 10 which is indicated only partially.

The driving member is provided adjacent to the coupling 2 with a toothed portion 14, by means of which a gear wheel 15 of a centrifugal governor 16 can be driven. The flyweights 17 of the centrifugal governor 16 act directly on an axially displaceable control piston 18, by means of which a pressure chamber 19 of the work piston 11 can be connected either with a pressurized oil port 20 or a pressureless oil return 21, for which purpose the required annular grooves are shown as being disposed within the housing 10 and in the control piston 18, respectively. The control piston 18 serves, therefore, as a valve.

The control piston 18 is hollow and a rod 22 is displaceably guided therein against the force of a spring 23. The spring 23 is disposed between an adjustable stop 24 and a shoulder 18*a* of the control piston 18. A two-armed lever 25 acts on the end of the rod 22 opposite the centrifugal governor 16, and the other free arm of the lever 25 is arranged to contact the front face of the work piston 11, so that the position of the work piston 11 may be controlled by the control piston 18.

Mode of operation of the apparatus shown in FIG. 1

When a change occurs in the rpm, a displacement of the control piston 18 takes place as a result of the change in position of the flyweights 17. For example, when the rpm increases, the displacement is toward the right. In this way, the entry of pressurized oil from the pressurized oil port 20 into the pressure chamber 19 of the work piston 11 is possible, so that the work piston 11, together with the sleeve 5, is displaced toward the right. As a result, and by means of the gear portions 4, 4', there is a relative rotation of the members 3 and 8 corresponding to the displacement path of the sleeve 5 and the helix angle of the gear portions 4, 4'. The movement of the piston 11 toward the right causes the work piston 11 to pivot the lever 25, and thereby to displace the rod 22. As a result, the spring 23 is further compressed, by means of which a certain backward (toward the left) movement of the control piston 18 and thereby a closing off of the pressurized oil port 20 is accomplished.

Figure 2:
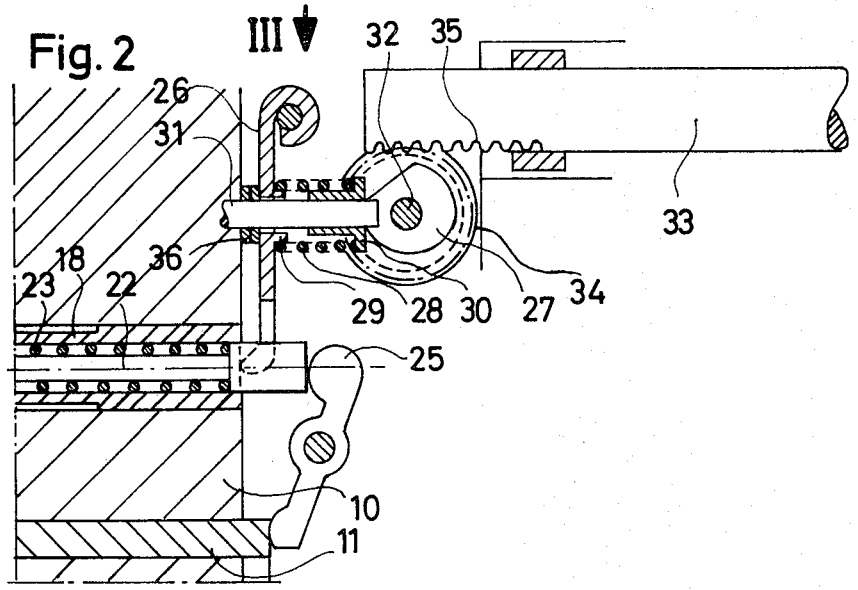
FIG. 2 is a partial cross-sectional side view of a pickup for the regulator rod which detects the position of the regulator rod and transfers it via a cam plate and a swingable lever, to a control piston of a valve member controlling the displacement of the sleeve.
Figure 3:
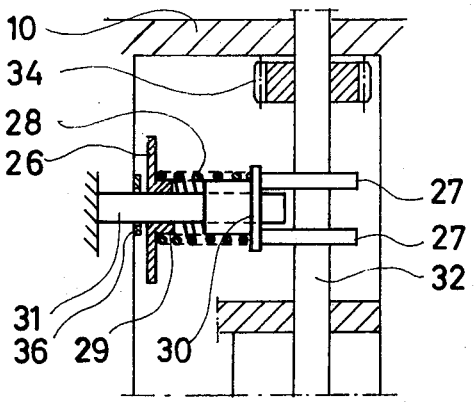
FIG. 3 is a top view of the pickup illustrated in FIG. 2 looking in the direction of the arrow III with the regulator rod omitted, and with two cam plates shown.

Description of the first embodiment of the invention illustrated in FIGS. 2 and 3

In order to obtain an adjustment of the mutual angular relationship of the members 3 and 8, which is also dependent on the torque output of the internal combustion engine, there is provided a swingable one-armed lever 26, in addition to the embodiment of the apparatus shown in FIG. 1. The lever 26 acts on the control piston 18. A spring 28 which is variable in its initial stressing because of the inclusion therewith of cam plate 27 is associated with this swingable one-armed lever 26.

In order to reduce friction, the spring 28 has one end arranged to be held on a collar 29 that is integral with the lever 26, while the other end of the spring 28 is arranged to abut an annular flange provided on a sleeve 30. The sleeve 30 is displaceable on a guide rod 31, the latter being fixedly mounted to the housing 10. In order to further reduce friction, two parallel cam plates 27, which extend laterally and in planes parallel to the guide rod 31, are provided (FIG. 3) rather than a single cam plate. These cam plates 27 are mounted on a rotatable shaft 32, on which there is also mounted a gear wheel 34, which meshes with a toothed portion 35 of a regulator rod 33 (see FIG. 2) of an injection pump, not shown in further detail. By an appropriate selection of the diameter and profile of the cam plates 27, a loading of the control piston 18 can be obtained which is dependent on the position of the regulator rod 33.

In order to limit the pivoting range of the lever 26, a further adjustable stop 36 can efficiently be disposed on the guide rod 31.

The lever 26, cam plates 27, spring 28, sleeve 30, shaft 32, gear wheel 35 and stop 36 comprise a pickup which detects the position of the regulator 33 and transfers it to the control piston 18.

Figure 4:
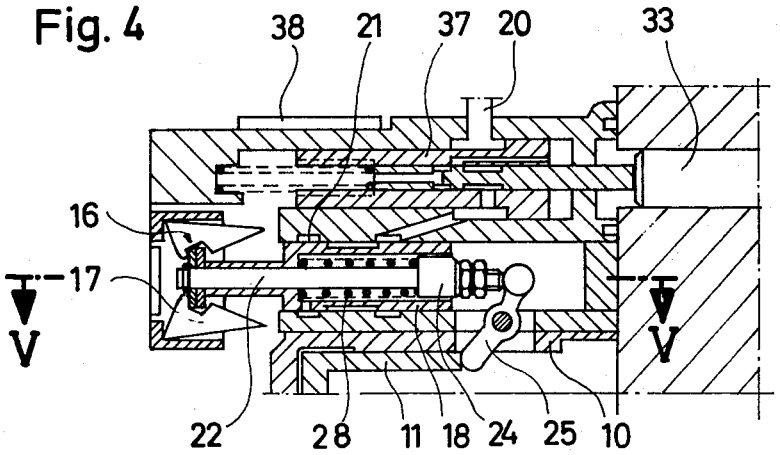
FIG. 4 is a partial cross-sectional view of a further embodiment of a pickup for the regulator rod.
Figure 5:
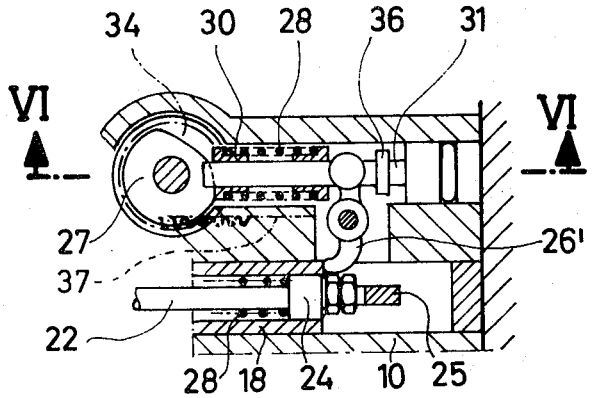
FIG. 5 is a cross-sectional view through the structure of FIG. 4 taken along the line V—V.
Figure 6:
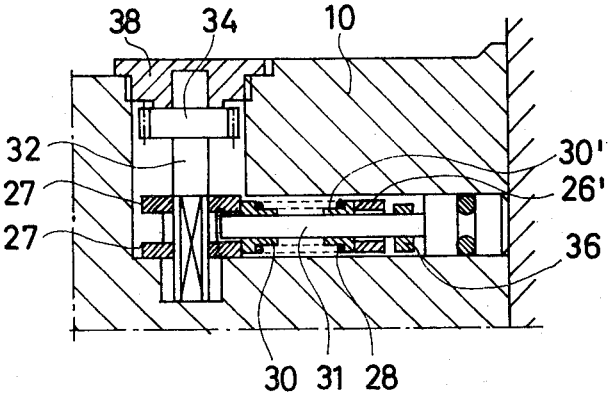
FIG. 6 is a cross-sectional view through the structure of FIG. 5 taken along the line VI—VI.

Since the effects of force on the regulator rod 33 are generally undesirable, the pickup function can also be performed by means of a follow-up piston, as is shown in FIGS. 4–6.

Description of a second embodiment in accordance with FIGS. 4–6

In order to transfer the displacement of the regulator rod 33 to a swingable lever 26', there is provided a follow-up piston 37 as an extension of the regulator rod 33. This follow-up piston 37 can be supplied pressurized oil via the pressurized oil port 20 in the same manner as described earlier herein. By means of appropriate grooves and transverse bores, this follow-up piston 37 follows the movements of the regulator rod 33, without inhibiting the regulator rod in its mobility. The follow-up piston 37 is provided with a toothed portion which is shown only partially in FIGS. 4 and 5, with which the gear wheel 34 meshes. The gear wheel 34 and cam plates 27, cooperating with the lever 26', are disposed on the shaft 32. The rotatable shaft 32, as may be best seen from FIGS. 4 and 6, is disposed lying behind the centrifugal governor 16 and is supported within a cap 38.

Similarly to the embodiment of FIGS. 2 and 3, the sleeve 30 and a further sleeve 30' are displaceably guided on the guide rod 31 with the interposition of the spring 28. The sleeve 30' contacts the forked end of the lever 26' and effects an exertion of force on the lever 26' which is transferred to the control piston 18. This exertion of force is dependent on the curve form of the cam plates 27 and on the position of the lever 26'. The mode of operation of this embodiment is identical to that of the first embodiment described above.

The foregoing relates to preferred embodiments of the invention, it being understood that other embodiments and variants thereof are possible within the spirit and scope of the invention, the latter being defined by the appended claims.

What is claimed and desired to be secured by Letters Patent of the United States is:

1. In an apparatus for setting the angular relationship between a rotating drive member and a driven member in the drive of a fuel injection pump of an internal combustion engine, said drive including: the drive member having a toothed portion; the driven member having a toothed portion; and a coupler having toothed portions complemental to the toothed portions of the drive member and the driven member, with at least one of the toothed portions of the drive member and driven member and the complemental toothed portion of the coupler being helical toothed portions, said apparatus including hydraulic displacement means for hydraulically displacing the coupler and thereby at least the driven member to attain an rpm-dependent adjustment of the instant of injection, said hydraulic displacement means including: a valve member; at least one spring; and a centrifugal governor having flyweights which produce an rpm-dependent displacement of the valve member against the force exerted by said at least one spring, and thereby the hydraulic displacement of the coupler and at least the driven member, the improvement in the apparatus comprising load-dependent displacement means connected to the hydraulic displacement means for further displacing the coupler and thereby at least the driven member in a load dependent manner, to attain a further adjustment of the instant of injection which is load-dependent, said load dependent displacement means including at least one prestressed spring.

2. The apparatus as defined in claim 1, wherein the fuel injection pump includes a regulator rod, and wherein the regulator rod applies a load-dependent input to said load-dependent displacement means.

3. The apparatus as defined in claim 2, wherein the load-dependent displacement means comprises a swingable lever the free end of which acts upon said valve member, said lever being loaded with a force in dependence on the regulator rod position.

4. The apparatus as defined in claim 3, wherein the load-dependent displacement means further comprises: at least one adjustable cam plate; guide means; said at least one prestressed spring disposed between the guide means and the swingable lever, and wherein said at least one adjustable cam plate is rotatable in dependence on the movement of the regulator rod and the guide means is displaceable by said at least one adjustable cam plate.

5. The apparatus as defined in claim 4, wherein the guie means comprises a guide rod and a sleeve displaceable on the guide rod, said guide sleeve having a contact connection for said spring.

6. The apparatus as defined in claim 5, wherein the load-dependent displacement means comprises identical parallel cam plates, one on each side of the guide rod, wherein the guide sleeve has a front face which contacts the cam plates.

7. The apparatus as defined in claim 3, wherein the load-dependent displacement means further comprises an adjustable stop which limits the pivotal movement of the swingable lever.

8. The apparatus as defined in claim 1, wherein the load-dependent displacement means comprises: at least one adjustable cam plate; and means for actuating said at least one adjustable cam plate for further displacing said valve member.

9. The apparatus as defined in claim 8, wherein said at least one adjustable cam plate is actuated for further displacing said valve member against the force of said at least one prestressed spring.

10. The apparatus as defined in claim 9, wherein the fuel injection pump includes a regulator rod having a toothed portion, wherein the means for actuating said at least one adjustable cam plate comprises a rotatable shaft on which said at least one adjustable cam plate is mounted, and a gear wheel mounted to said rotatable shaft which meshes with the toothed portion of the regulator rod, and wherein the regulator rod applies a load-dependent input to said load-dependent displacement means.

11. The apparatus as defined in claim 9, wherein the fuel injection pump includes a regulator rod, wherein the means for actuating said at least one adjustable cam plate comprises a hydraulically guided subsequent follow-up piston having a toothed portion, a rotatable shaft on which said at least one adjustable cam plate is mounted, and a gear wheel mounted to said rotatable shaft which meshes with the toothed portion of the follow-up piston, and wherein the regulator rod cooperates with the follow-up piston.

12. The apparatus as defined in claim 8, wherein the load-dependent displacement means further comprises: guide means; a swingable lever; said at least one prestressed spring disposed between the guide means and the swingable lever, and wherein said at least one adjustable cam plate is rotatable in dependence on the movement of the regulator rod and the guide means is displaceable by said at least one adjustable cam plate.

13. The apparatus as defined in claim 12, wherein the guide means comprises a guide rod and a sleeve displaceable on the guide rod, said guide sleeve having a contact connection for said spring.

14. The apparatus as defined in claim 13, wherein the load-dependent displacement means comprises identical parallel cam plates, one one each side of the guide rod, wherein the guide sleeve has a front face which contacts the cam plates.

* * * * *